US008550044B2

(12) United States Patent
Dopona et al.

(10) Patent No.: US 8,550,044 B2
(45) Date of Patent: Oct. 8, 2013

(54) AIR SPRING SYSTEM FOR AN INTERNAL COMBUSTION ENGINE

(75) Inventors: Michael Dopona, Wartberg (AT); Johann Neuboeck, Gunskirchen (AT); Werner Brandstaetter, Meggenhofen (AT); Christian Berger, Offenhausen (AT); Roland Ennsmann, Wels (AT); Gerhard Wiesinger, Lenzing (AT); Stefan Leiber, Marchtrenk (AT); Roland Spatzenegger, Bad Hall (AT)

(73) Assignee: BRP-Powertrain GmbH & Co. KG, Gunskirchen (AT)

( * ) Notice: Subject to any disclaimer, the term of this patent is extended or adjusted under 35 U.S.C. 154(b) by 473 days.

(21) Appl. No.: 12/690,545

(22) Filed: Jan. 20, 2010

(65) Prior Publication Data

US 2010/0180841 A1 Jul. 22, 2010

Related U.S. Application Data

(60) Provisional application No. 61/145,876, filed on Jan. 20, 2009.

(51) Int. Cl.
*F01L 9/02* (2006.01)

(52) U.S. Cl.
USPC ..... 123/90.14; 123/90.16; 417/384

(58) Field of Classification Search
USPC ..... 123/90.14, 90.16; 417/384
See application file for complete search history.

(56) References Cited

U.S. PATENT DOCUMENTS

| | | | | |
|---|---|---|---|---|
| 1,695,011 | A | | 12/1928 | Fornaca |
| 2,094,828 | A | * | 10/1937 | Spelts ..... 123/74 B |
| 2,437,121 | A | | 3/1948 | Petersen |
| 3,120,221 | A | | 2/1964 | Lyons |
| 4,592,313 | A | | 6/1986 | Speckhart |
| 4,674,462 | A | | 6/1987 | Koch et al. |

(Continued)

FOREIGN PATENT DOCUMENTS

| | | |
|---|---|---|
| CH | 671808 | 9/1989 |
| DE | 10113095 A1 | 9/2002 |

(Continued)

OTHER PUBLICATIONS

F1 Engine Power Secrets [online], Jun. 2000, [retrieved on Jun. 1, 2009]. Retrieved from the Internet: < URL: http://www.pureluckdesign.com/ferrari/f1engine>.

(Continued)

*Primary Examiner* — Ching Chang
(74) *Attorney, Agent, or Firm* — BCF LLP

(57) ABSTRACT

An internal combustion engine has at least one intake valve and at least one exhaust valve. A first spring biases the at least one intake valve to a closed position. A second spring biases the at least one exhaust valve to a closed position. At least one of the first and second springs is an air spring. An air compressor fluidly communicates with the air spring to supply air to the air spring. The air compressor is operatively connected to a rotating shaft of the engine to be selectively driven thereby. A motor is operatively connected to the air compressor to selectively drive the air compressor. A method of supplying air to the air spring of the above engine is also disclosed. A method of supplying air to an air spring of an engine having both a mechanical and an electrical air compressor is also disclosed.

16 Claims, 13 Drawing Sheets

(56) References Cited

U.S. PATENT DOCUMENTS

| | | | | |
|---|---|---|---|---|
| 5,058,541 | A | 10/1991 | Shibata et al. | |
| 5,233,950 | A | 8/1993 | Umemoto et al. | |
| 5,553,572 | A | 9/1996 | Ochiai | |
| 5,586,529 | A | 12/1996 | Vallve | |
| 5,664,527 | A | 9/1997 | Boudy | |
| 6,083,140 | A | 7/2000 | Kimura | |
| 6,283,099 | B1 | 9/2001 | Dopona | |
| 6,745,738 | B1 | 6/2004 | Bosscher | |
| 7,765,973 | B2 * | 8/2010 | Matsuda | 123/90.65 |
| 2003/0075143 | A1 | 4/2003 | Hallam | |
| 2005/0217619 | A1 | 10/2005 | Martinez | |

FOREIGN PATENT DOCUMENTS

| | | | |
|---|---|---|---|
| EP | 0396327 | B1 | 12/1992 |
| EP | 0646700 | B1 | 3/1999 |
| EP | 0697540 | B1 | 9/1999 |
| EP | 0824180 | B1 | 5/2001 |
| EP | 0722043 | B1 | 10/2001 |
| EP | 1143115 | B1 | 1/2004 |
| FR | 569131 | A | 4/1924 |
| FR | 2529616 | B1 | 3/1987 |
| GB | 392294 | | 5/1933 |
| GB | 2102065 | A | 1/1983 |
| JP | 63009609 | A2 | 1/1988 |
| JP | 2230909 | A2 | 9/1990 |
| JP | 2283806 | A2 | 11/1990 |
| JP | 2294506 | A2 | 12/1990 |
| JP | 3194103 | A2 | 8/1991 |
| JP | 5039704 | A2 | 2/1993 |
| JP | 5052103 | A2 | 3/1993 |
| JP | 5059916 | A2 | 3/1993 |
| JP | 5079307 | A2 | 3/1993 |
| JP | 6159024 | A2 | 6/1994 |
| JP | 6248912 | A2 | 9/1994 |
| JP | 10288012 | A2 | 10/1998 |
| JP | 2003222011 | A2 | 8/2003 |
| JP | 2007309176 | | 11/2007 |
| WO | 0149980 | A1 | 7/2001 |
| WO | 2009087441 | A1 | 7/2009 |

OTHER PUBLICATIONS

Valve System Image [online], [retrieved on Jun. 1, 2009]. Retrieved from the Internet: < URL: http://www.pureluckdesign.com/ferrari/f1engine/valvesystem1.jpg>.
English Abstract of JP2007309176.
English Abstract of JP63009609.
English Abstract of JP6159024.
English Abstract of JP5079307.
English Abstract of JP5059916.
English Abstract of JP2230909.
English Abstract of JP2003222011.
English Abstract of JP10288012.
English Abstract of DE10113095.
English Abstract of EP0824180.
English Abstract of EP1143115.
English Abstract of JP6248912.
English Abstract of JP5052103.
English Abstract of JP5039704.
English Abstract of JP3194103.
English Abstract of JP2294506.
English Abstract of JP2283806.
English Abstract of FR2529616.
English Abstract of EP0697540.
English Abstract of CH671808.
Search Report from EP 10 15 1097 dated Apr. 27, 2010: Munich.
English translation of French patent No. 569 131.
Valve System Image [online], 1993, [retrieved on Jun. 1, 2009]. Retrieved from the Internet: <URL: http://www.pureluckdesign.com/ferrari/f1engine/valvesystem1.jpg>.
English Abstract of JP2007-309176, Published Nov. 29, 2007; Retrieved from http://v3.espacenet.com on May 6, 2010.
English Abstract of JP63009609, Published Jan. 16, 1988; Retrieved from http://v3.espacenet.com on May 11, 2010.
English Abstract of JP6159024, Published Jun. 7, 1994; Retrieved from http://v3.espacenet.com on May 11, 2010.
English Abstract of JP5079307, Published Mar. 30, 1993; Retrieved from http://v3.espacenet.com on May 11, 2010.
English Abstract of JP5059916, Published Mar. 9, 1993; Retrieved from http://v3.espacenet.com on May 11, 2010.
English Abstract of JP2230909, Published Sep. 13, 1990; Retrieved from http://v3.espacenet.com on May 11, 2010.
English Abstract of JP2003222011, Published Aug. 8, 2003; Retrieved from http://v3.espacenet.com on May 11, 2010.
English Abstract of JP10288012, Published Oct. 27, 1998; Retrieved from http://v3.espacenet.com on May 11, 2010.
English Abstract of DE10113095, Published Sep. 26, 2002; Retrieved from http://v3.espacenet.com on May 11, 2010.
English Abstract of EP0824180, Published May 30, 2001; Retrieved from http://v3.espacenet.com on May 11, 2010.
English Abstract of EP1143115, Published Jan. 28, 2004; Retrieved from http://v3.espacenet.com on May 11, 2010.
English Abstract of JP6248912, Published Sep. 6, 1994; Retrieved from http://v3.espacenet.com on May 11, 2010.
English Abstract of JP5052103, Published Mar. 2, 1993; Retrieved from http://v3.espacenet.com on May 11, 2010.
English Abstract of JP5039704, Published Feb. 19, 1993; Retrieved from http://v3.espacenet.com on May 11, 2010.
English Abstract of JP3194103, Published Aug. 23, 1991; Retrieved from http://v3.espacenet.com on May 11, 2010.
English Abstract of JP2294506, Published Dec. 5, 1990; Retrieved from http://v3.espacenet.com on May 11, 2010.
English Abstract of JP2283806, Published Nov. 21, 1990; Retrieved from http://v3.espacenet.com on May 11, 2010.
English Abstract of FR2529616, Published Mar. 27, 1987; Retrieved from http://v3.espacenet.com on May 11, 2010.
English Abstract of EP0697540, Published Sep. 29, 1999; Retrieved from http://v3.espacenet.com on May 11, 2010.
English Abstract of CH671808, Published Sep. 29, 1989; Retrieved from http://v3.espacenet.com on May 11, 2010.
English Translation of French Patent FR569131, Published Apr. 7, 1924; Mike Petrigliano, Jun. 7, 2010.

* cited by examiner

AIR SPRING SYSTEM FOR AN INTERNAL COMBUSTION ENGINE

CROSS-REFERENCE

The present application claims priority to U.S. Provisional Patent Application No. 61/145,876, filed Jan. 20, 2009, the entirety of which is incorporated herein by reference.

FIELD OF THE INVENTION

The present invention relates to an air spring system for an internal combustion engine.

BACKGROUND OF THE INVENTION

Many internal combustion engines, such as engines operating on the four-stroke principle, have intake and exhaust valves provided in the cylinder head of the engine. The intake valves open and close to selectively communicate the air intake passages of the engine with the combustion chambers of the engine. The exhaust valves open and close to selectively communicate the exhaust passages of the engine with the combustion chambers of the engine.

To open the valves, many engines are provided with one or more camshafts having one or more cams provided thereon. The rotation of the camshaft(s) causes the cam(s) to move the valves to an opened position. Metallic coil springs are usually provided to bias the valves toward a closed position.

Although metallic coil springs effectively bias the valves toward their closed positions for most engine operating conditions, at high engine speeds, the metallic coil springs have a tendency to resonate. When resonating, the metallic coil springs cause the valves to vacillate between their opened and closed positions, which, as would be understood, causes the intake and exhaust passages inside which the valves are connected to be opened when they should be closed. This results in a reduction of operating efficiency of the engine at high engine speeds.

One solution to this problem consists in replacing the metallic coil springs with air springs. An air spring typically consists of a cylinder having a piston therein. An air chamber is defined between the cylinder and the piston. The valve (intake or exhaust) is connected to the piston of the air spring. When the cam moves the valve to its opened position, the piston of the air spring moves with the valve, thus reducing the volume of the air chamber and as a result increasing the air pressure therein. When the cam no longer pushes down on the valve, the air pressure inside the air chamber causes the piston of the air spring to return to its initial position and to return the valve to its closed position.

Air springs do not resonate at high engine speeds the way metallic coil springs do. Also, for equivalent spring forces, air springs are lighter than metallic coil springs. Furthermore, air springs have progressive spring rates, which means that the spring force of an air spring varies depending on the position of the piston inside the cylinder of the air spring, which may also be advantageous for certain engines.

Although air springs offer many advantages over metallic coil springs, they also have some deficiencies that need to be addressed.

One of these deficiencies is that during operation, some of the air inside the air chamber of the air spring blows by the piston as the piston moves to reduce the volume of the air chamber. As a result, the air pressure inside the air spring is reduced, thus reducing the spring force of the air spring. This results in the valve not returning to its closed position as fast as it should, thus reducing the efficiency of the engine. In extreme cases, it is possible that the air pressure inside the air spring is insufficient to return the valve to its closed position. Since the valve remains in its opened position, the engine no longer operates properly, and the piston of the engine can come into contact with the valve, potentially damaging the valve.

One solution consists in providing a reservoir of pressurized air in fluid communication with the air springs that replenishes the air inside the air springs as it leaks out of the air springs. However, the pressurized air inside the reservoir is eventually depleted and the reservoir needs to be refilled or replaced. This can prove to be inconvenient for the users of the vehicle or device inside which the engine is provided.

Therefore, there is a need for a system for replenishing air inside an air spring used to bias a valve of an engine that does not require frequent replacement or refilling.

Another of the deficiencies associated with air springs is that even when the engine is not is use, air can leak out of the air springs. When the air pressure inside the air springs becomes too low, this causes the valves to move to their opened positions. When this occurs and the engine is started, the pistons of the engine can come into contact with the valves, potentially damaging the valves, and as a result preventing operation of the engine.

One possible solution consists in providing metallic coil springs having a relatively low spring constant in addition to the air springs. The metallic coil springs are strong enough to bias the valves towards their closed position even when the air pressure inside the air springs is no longer sufficient to do so on its own. However, these metallic coil springs do not provide enough biasing force to return the valves to their closed position fast enough while the engine is in operation. Although the addition of these metallic coil springs will prevent the pistons of the engine from coming into contact with the valves when the engine is started, they add weight and complexity to the air spring system. The additional metallic coil springs can also lead to some resonance as the speed of the engine increases.

Therefore, there is a need for a system for replenishing air inside an air spring used to bias a valve of an engine before the engine is started.

SUMMARY OF THE INVENTION

It is an object of the present invention to ameliorate at least some of the inconveniences present in the prior art.

It is also an object of the present invention to provide an internal combustion engine having at least one of an intake and an exhaust valve biased to a closed position by an air spring. An air compressor supplies air to the air spring. At least one rotating shaft of the engine selectively drives the air compressor. A motor also selectively drives the air compressor.

It is another object of the present invention to provide a method of supplying air to an air spring biasing one of an intake valve and an exhaust valve of an internal combustion engine to a closed position. The engine has an air compressor for supplying air to the air spring. The air compressor can be driven by a motor and by a rotating shaft of the engine. The motor drives the air compressor prior to engine start-up, and once the engine has started, the rotating shaft of the engine drives the air compressor.

It is yet another object of the present invention to provide a method of supplying air to an air spring biasing one of an intake valve and an exhaust valve of an internal combustion engine to a closed position. The engine has an electrical air compressor and a mechanical air compressor driven by a rotating shaft of the engine. Either one of the air compressors can be driven to supply air to the air compressor. The electric air compressor supplies air to the air spring prior to engine start-up, and once the engine has started, the mechanical air compressor supplies air to the air spring.

In one aspect, the invention provides an internal combustion engine having a crankcase, a cylinder block connected to the crankcase, the cylinder block defining a cylinder, a piston disposed in the cylinder, at least one rotating shaft operatively connected to the piston, and a cylinder head connected to the cylinder block. The cylinder head, the cylinder and the piston define a combustion chamber therebetween. At least one intake passage fluidly communicates with the combustion chamber. At least one intake valve is disposed in the at least one intake passage. The at least one intake valve selectively communicates the at least one intake passage with the combustion chamber. A first spring is operatively connected to the at least one intake valve. The first spring biases the at least one intake valve to a closed position preventing fluid communication between the at least one intake passage and the combustion chamber. At least one exhaust passage fluidly communicates with the combustion chamber. At least one exhaust valve is disposed in the at least one exhaust passage. The at least one exhaust valve selectively communicates the at least one exhaust passage with the combustion chamber. A second spring is operatively connected to the at least one exhaust valve. The second spring biases the at least one exhaust valve to a closed position preventing fluid communication between the at least one exhaust passage and the combustion chamber. At least one of the first and second springs is an air spring. An air compressor fluidly communicates with the air spring to supply air to the air spring. The air compressor is operatively connected to the at least one rotating shaft. The at least one rotating shaft selectively drives the air compressor. A motor is operatively connected to the air compressor. The motor selectively drives the air compressor.

In a further aspect, both the first and second springs are air springs. The first spring is a first air spring, and the second spring is a second air spring. The air compressor fluidly communicates with the first and second air springs to supply air to the first and second air springs.

In an additional aspect, the air compressor fluidly communicates in series with the first and second air springs.

In a further aspect, the at least one intake valve is biased to the closed position only by the first air spring, and the at least one exhaust valve is biased to the closed position only by the second air spring.

In an additional aspect, a crankshaft is disposed in the crankcase and is operatively connected to the piston. At least one camshaft is disposed in the cylinder head and is operatively connected to the crankshaft. At least one cam is disposed on the at least one camshaft. The at least one cam engages the intake and exhaust valves. The at least one rotating shaft selectively driving the air compressor is the at least one camshaft.

In a further aspect, the at least one camshaft includes an intake camshaft and an exhaust camshaft. The at least one cam includes at least one intake cam disposed on the intake camshaft and at least one exhaust cam disposed on the exhaust camshaft. Rotation of the intake camshaft causes the at least one intake cam to engage the at least one intake valve such that the at least one intake cam moves the at least one intake valve to an opened position where the at least one intake passage fluidly communicates with the combustion chamber. Rotation of the exhaust camshaft causes the at least one exhaust cam to engage the at least one exhaust valve such that the at least one exhaust cam moves the at least one exhaust valve to an opened position where the at least one exhaust passage fluidly communicates with the combustion chamber. The at least one camshaft selectively driving the air compressor is the intake camshaft.

In an additional aspect, a first overrunning clutch selectively connects the at least one camshaft to the air compressor, and a second overrunning clutch selectively connects the motor to the air compressor.

In a further aspect, a compressor driving shaft operatively engages the air compressor. The first overrunning clutch selectively connects the at least one camshaft to a first end portion of the compressor driving shaft. The second overrunning clutch selectively connects the motor to a second end portion of the compressor driving shaft.

In an additional aspect, the compressor driving shaft is a tubular shaft. The compressor driving shaft is coaxial with the at least one camshaft. An end portion of the at least one camshaft is disposed inside the first end portion of the compressor driving shaft and the first overrunning clutch is disposed between the end portion of the at least one camshaft and the first end portion of the compressor driving shaft.

In a further aspect, a secondary shaft is operatively connected to the motor. The secondary shaft is coaxial with the compressor driving shaft. A first end portion of the secondary shaft is disposed inside the second end portion of the compressor driving shaft and the second overrunning clutch is disposed between the first end portion of the secondary shaft and the second end portion of the compressor driving shaft.

In an additional aspect, the motor has a motor shaft, and the motor shaft is perpendicular to the secondary shaft.

In a further aspect, a secondary shaft gear is disposed on a second end portion of the secondary shaft. A motor gear is disposed on the motor shaft and engages the secondary shaft gear.

In an additional aspect, the air compressor is a reciprocating air compressor. A compressor driving cam is disposed on the compressor driving shaft, such that rotation of the compressor driving shaft causes the compressor driving cam to drive the air compressor.

In a further aspect, the cylinder defines a cylinder axis. The air compressor is disposed between the at least one camshaft and the crankshaft in a direction parallel to the cylinder axis.

In an additional aspect, a crankshaft is disposed in the crankcase and is operatively connected to the piston. The crankshaft defines a crankshaft axis. The air compressor is disposed between the air spring and the motor in a direction parallel to the crankshaft axis.

In a further aspect, the air compressor is disposed inside the cylinder head.

In an additional aspect, a pressure relief valve fluidly communicates with the air compressor and the air spring.

In another aspect, the invention provides a method of supplying air to an air spring biasing one of an intake valve and an exhaust valve of an internal combustion engine to a closed position. The method comprises: driving an air compressor with a motor prior to starting of the internal combustion engine, the air compressor fluidly communicating with the air spring to supply air to the air spring; determining that a predetermined condition has been reached; starting the engine once the predetermined condition has been reached; and driving the air compressor with a rotating shaft of the engine once the engine has started.

In a further aspect, the predetermined condition is a predetermined amount of time for which the air compressor is driven by the motor.

In an additional aspect, the predetermined condition is a predetermined air pressure indicative of an air pressure inside the air spring.

In yet another aspect, the invention provides a method of supplying air to an air spring biasing one of an intake valve and an exhaust valve of an internal combustion engine to a closed position. The method comprises: driving an electrical air compressor prior to starting of the internal combustion engine, the electrical air compressor fluidly communicating with the air spring to supply air to the air spring; determining that a predetermined condition has been reached; starting the engine once the predetermined condition has been reached; driving a mechanical air compressor with a rotating shaft of the engine once the engine has started, the mechanical air compressor fluidly communicating with the air spring to supply air to the air spring; and stopping the electrical air compressor once the predetermined condition has been reached.

In a further aspect, stopping the electrical air compressor once the predetermined condition has been reached includes: stopping the electrical air compressor once the predetermined condition has been reached and the mechanical air compressor is being driven with the rotating shaft of the engine.

In an additional aspect, the predetermined condition is a predetermined amount of time for which the electrical air compressor is driven.

In a further aspect, the predetermined condition is a predetermined air pressure indicative of an air pressure inside the air spring.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 2:
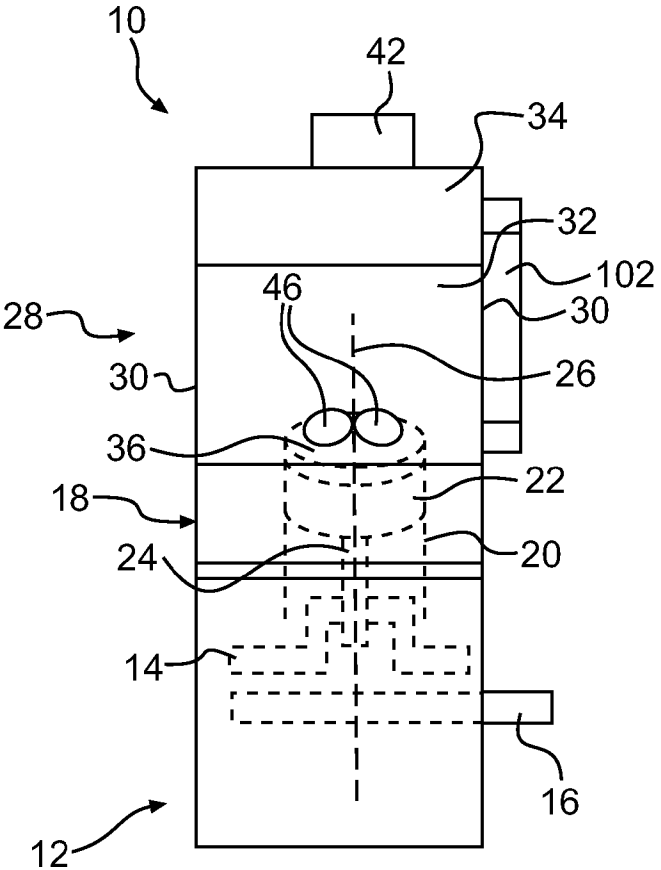
FIG. 2 is an end elevation view of the engine of FIG. 1.
Figure 1:
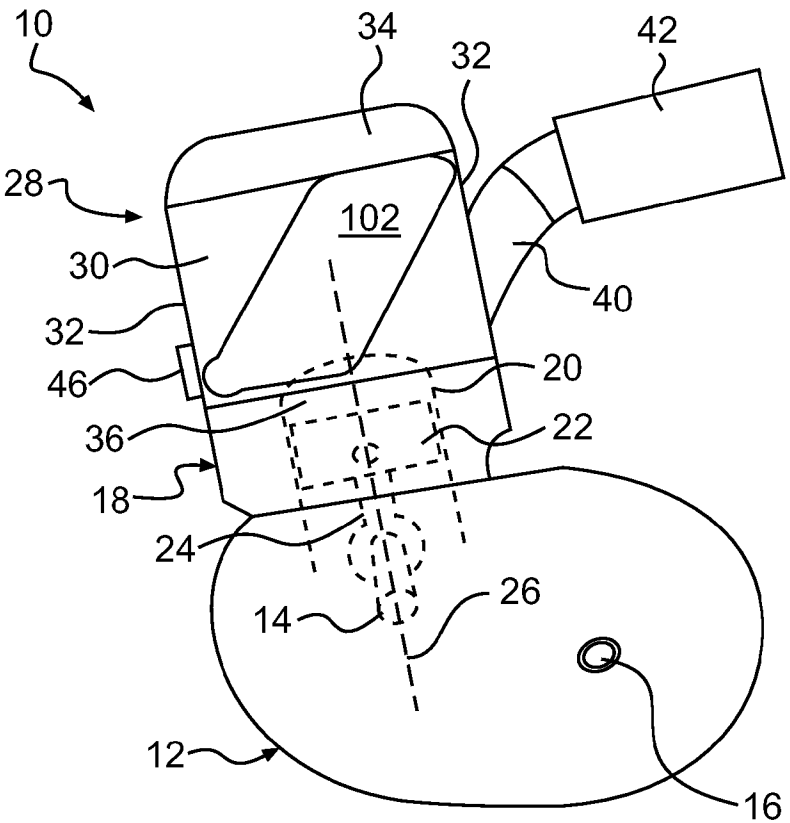
FIG. 1 is a side elevation view of an internal combustion engine according to the present invention.

An internal combustion engine 10 in accordance with the present invention will be described with reference to FIGS. 1 to 3. The engine 10 operates on the four-stroke principle, however it is contemplated that aspects of the present invention could be used on engines operating on other principles and having intake and/or exhaust valves. The engine 10 has a crankcase 12. The crankcase 12 houses a crankshaft 14 and an output shaft 16. The output shaft 16 is operatively connected to the crankshaft 14 via a transmission (not shown) also housed in the crankcase 12. The output shaft 16 extends out of the crankcase 12 to transmit power from the engine 10 to an element operatively connected to the output shaft 16. In the case where the engine 10 is provided in a wheeled vehicle, such as a motorcycle, the output shaft 16 is operatively connected to the wheels of the vehicle to transmit power from the engine 10 to the wheels. It is contemplated that the engine 10 could be used in other types of vehicles, such as a snowmobile, or in other types of applications.

A cylinder block 18 is connected to the crankcase 12. The cylinder block 18 defines a cylinder 20. A piston 22 is disposed inside the cylinder 20. The piston 22 is connected by a connecting rod 24 to the crankshaft 14. During operation of the engine 10, the piston 22 reciprocates inside the cylinder 20 along a cylinder axis 26 defined by the cylinder 20, thus driving the crankshaft 14, which drives the output shaft 16 via the transmission. It is contemplated that the cylinder block 18 could define more than one cylinder 20, and, as a result, the engine 10 would have a corresponding number of pistons 22 and associated parts. It is also contemplated that the engine could be a V-type engine having two cylinder blocks 18.

A cylinder head 28 is connected to the cylinder block 18. The cylinder head 28 has two side walls 30, two end walls 32, and a cylinder head cover 34. The cylinder head 28, the cylinder 20, and the piston 22 define a variable volume combustion chamber 36 of the engine 10 therebetween.

Figure 3:
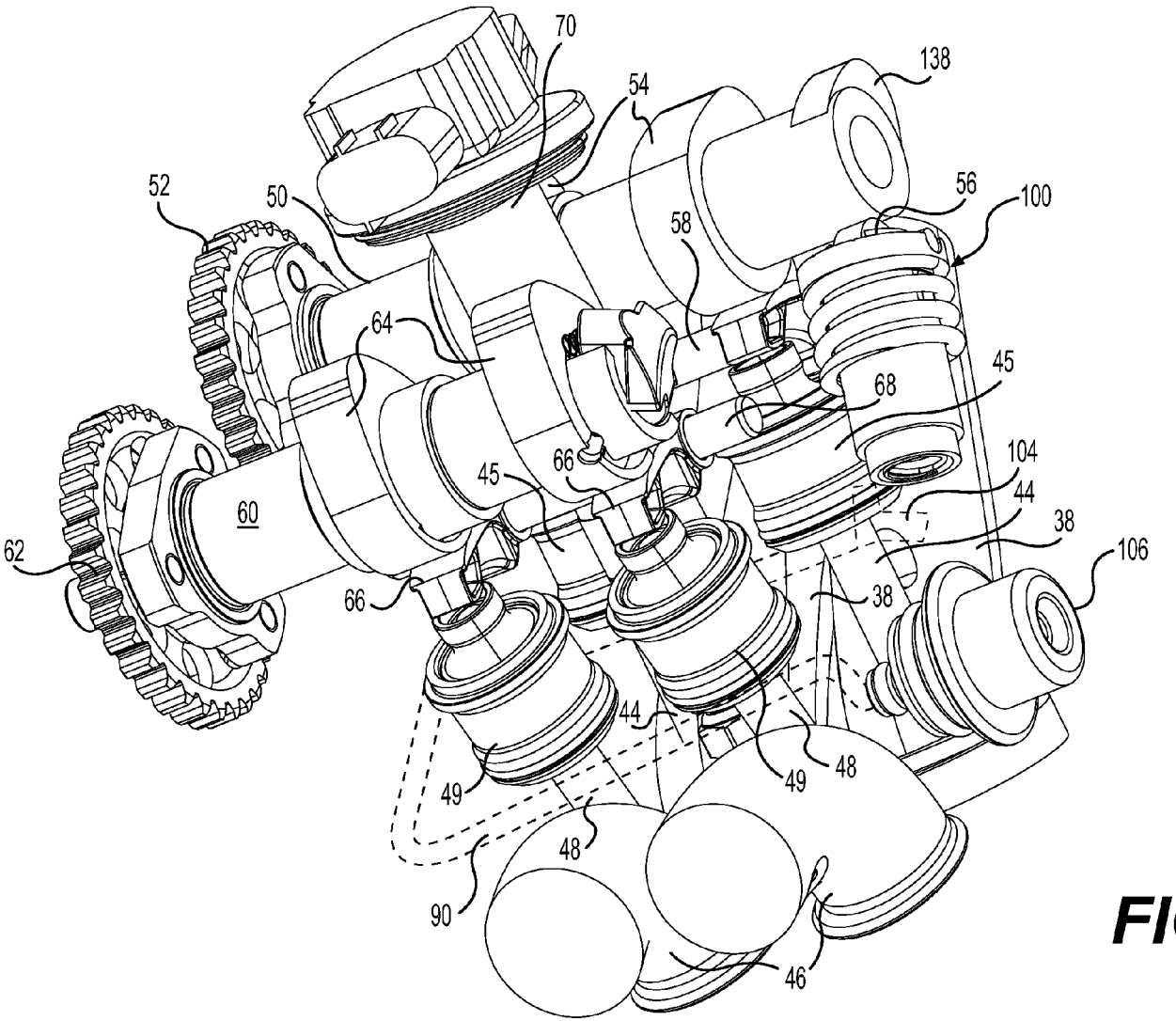
FIG. 3 is a perspective view of a first embodiment of internal components of a cylinder head of the engine of FIG. 1.

As seen in FIG. 3, two air intake passages 38 are provided in the cylinder head 28. One end of each air intake passage 38 is connected to the combustion chamber 36, and the other end of each air intake passage 38 is connected to a corresponding outlet of an air intake manifold 40 (FIG. 1) having a single inlet. A carburetor 42 (FIG. 1) is connected to the inlet of the air intake manifold 40. The carburetor 42 controls the flow of air and fuel that enters the combustion chamber 36 via the air intake passages 38. It is contemplated that the carburetor 42 could be replaced by a throttle body that only controls the flow of air to the combustion chamber 36, in which case a fuel injector in communication with the combustion chamber 36 would be provided in the engine 10. Each air intake passage 38 is provided with an intake valve 44 that is movable between an opened position and a closed position to allow or prevent, respectively, air and fuel to enter the combustion chamber 36 as described in greater detail below. Each intake valve 44 is provided with an air spring 45 that biases the intake valve 44 toward its closed position.

Two exhaust passages 46 are provided in the cylinder head 28. One end of each exhaust passage 46 is connected to the combustion chamber 36, and the other end of each exhaust passage 46 is connected to a corresponding inlet of an exhaust manifold (not shown) having a single outlet. The outlet of the exhaust manifold is connected to an exhaust system of the engine 10 which releases the exhaust gases from the engine 10 to the atmosphere. Each exhaust passage 46 is provided with an exhaust valve 48 that is movable between an opened position and a closed position to allow or prevent, respectively, exhaust gases to exit the combustion chamber 36 as described in greater detail below. Each exhaust valve 48 is provided with an air spring 49 that biases the exhaust valve 48 toward its closed position.

It is contemplated that there may be only one, or more than two, of each of the air intake and exhaust passages 38, 46 with a corresponding number of intake and exhaust valves 44, 48 and associated elements. It is also contemplated that there may be a different number of air intake and exhaust passages 38, 46. For example, it is contemplated that there could be two air intake passages 38 and a single exhaust passage 46. Also, although it is preferred that each of the valves 44, 48 be provided with an air spring 45 or 49, it is contemplated that only some of the valves 44, 48 (or only one of the valves 44, 48 should there be only one intake valve 44 and/or one exhaust valve 48) could be provided with an air spring 45 or 49.

An intake camshaft 50 is disposed in the cylinder head 28 generally parallel to a rotation axis of the crankshaft 14. A sprocket 52 is disposed at one end of the intake camshaft 50. A chain (not shown) operatively connects the sprocket 52 to a sprocket (not shown) operatively connected to the crankshaft 14, such that the intake camshaft 50 is driven by the crankshaft 14. Two intake cams 54 (one per intake valve 44) are disposed on the intake camshaft 50. Each intake cam 54 engages a corresponding intake cam follower 56 rotatably disposed on an intake cam follower shaft 58. Each air spring 45 is biased against its corresponding intake cam follower 56, such that, as the intake camshaft 50 rotates, each intake cam 54 pushes on its corresponding intake cam follower 56, which in turn pushes on its corresponding air spring 45 and moves the corresponding intake valve 44 to the opened position. As the intake camshaft 50 continues to rotate, each air spring 45 returns the corresponding intake valve 44 to its closed position.

An exhaust camshaft 60 is disposed in the cylinder head 28 generally parallel to the intake camshaft 50. A sprocket 62 is disposed at one end of the exhaust camshaft 60. A chain (not shown) operatively connects the sprocket 62 to a sprocket (not shown) operatively connected to the crankshaft 14, such that the exhaust camshaft 60 is driven by the crankshaft 14. Two exhaust cams 64 (one per exhaust valve 48) are disposed on the exhaust camshaft 60. Each exhaust cam 64 engages a corresponding exhaust cam follower 66 rotatably disposed on an exhaust cam follower shaft 68. Each air spring 49 is biased against its corresponding exhaust cam follower 66, such that, as the exhaust camshaft 60 rotates, each exhaust cam 64 pushes on its corresponding exhaust cam follower 66, which in turn pushes on its corresponding air spring 49 and moves the corresponding exhaust valve 48 to the opened position. As the exhaust camshaft 60 continues to rotate, each air spring 49 returns the corresponding exhaust valve 48 to its closed position.

It is contemplated that the cam followers 56, 66, and the cam follower shafts 58, 68 could be omitted and that the cams 54, 64 could engage the air springs 45, 49 and valves 44, 48 directly. It is also contemplated that the cam followers 56, 66 could be replaced by rocker arms. It is also contemplated that each cam 54, 64 could engage more than one valve 44, 48. It is also contemplated that there could be only one camshaft having both the intake and exhaust cams 54, 64 disposed thereon. It is also contemplated that the shape of the cams 54, 64 could be different from the one illustrated in the figures depending on the type of engine performance that is desired.

A spark plug 70 (FIG. 1) is disposed between the camshafts 50 and 60 and extends inside the combustion chamber 36 to ignite the air fuel mixture inside the combustion chamber 36.

Figure 4:
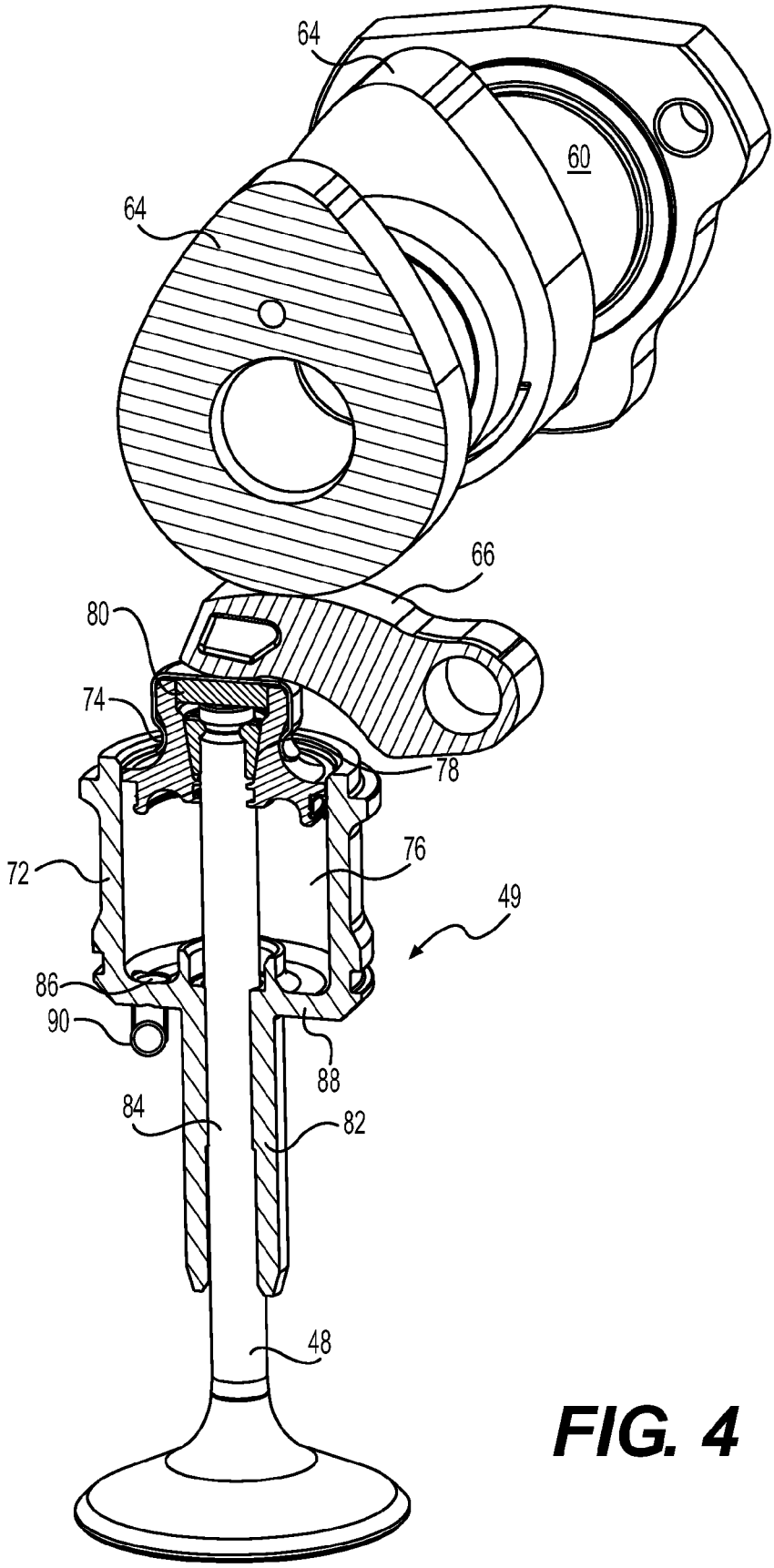
FIG. 4 is a partial cross-sectional view of a valve, air spring, and camshaft assembly of the engine of FIG. 1.

Turning now to FIG. 4, one of the air springs 49 will be described in more detail. The other air spring 49 and the air springs 45 have the same construction and as such will not be described in detail herein. The air spring 49 includes a cylinder 72 and a piston 74 disposed inside the cylinder 72 to reciprocally move therein. The top of the piston 74 is the portion of the air spring 49 which comes into contact with the exhaust cam follower 66. An air chamber 76 is defined between the cylinder 72 and the piston 74. A cotter 78 disposed around the end of the exhaust valve 48 connects the exhaust valve 48 to the piston 74 such that the piston 74 and the exhaust valve 74 reciprocate together. A shim 80 is disposed between the end of the exhaust valve 48 and the piston 74. The thickness of the shim 80 is selected such that the exhaust valve 48 will properly sit in the inlet of the exhaust passage 46 when the valve 48 is in its closed position and will extend to the desired position when the valve 48 is in its opened position. A valve stem guide 82 is integrally formed with the cylinder 72 and, as the name suggests, guides the stem 84 of the exhaust valve 48 to ensure that the exhaust valve 48 only moves along a straight line. An air port 86 is formed in the bottom 88 of the cylinder 72. The air port 86 is connected to an air supply line 90 used to supply air to the air chamber 76 of the air spring 49 as described in greater detail below. The air port 86 is dimensioned such that, as the piston 74 moves toward the bottom 88 of the cylinder 72, the air pressure inside the air chamber 76 will increase and the piston 74 (and the exhaust valve 48) will return to its initial position (due to the air pressure) before enough air drains out via the air port 86 to adversely affect the performance of the air spring 49.

Turning back to FIGS. 1 to 3, a first embodiment of the air spring system of the engine 10 will be described. A compressor 100, described in greater detail below, is disposed inside the cylinder head 28. During operation of the engine 10, the compressor 100 supplies air to the air springs 45, 49 via the air supply line 90 so as to maintain the air pressure inside the air springs 45, 49.

The compressor 100 is held inside a compressor cover 102 (FIGS. 1 and 2) that is fastened over an aperture (not shown) formed in one of the side walls 30 of the cylinder head 28. When the compressor cover 102 is in place as shown in FIGS. 1 and 2, the air compressor 100 is disposed just below the intake camshaft 50 so as to be driven by the intake camshaft 50, as will be described in more detail below. It is contemplated that the air compressor 100 could alternatively be driven by another rotating shaft of the engine 10, such as the exhaust camshaft 60 or the crankshaft 14. By supporting the air compressor 100 in the compressor cover 102, the air compressor 100 can be removed from the cylinder head 28 without having to remove the cylinder head cover 34 and the intake camshaft 50. Also, by locating the air compressor 100 inside the cylinder head 100 below the intake camshaft 50, the packaging of the cylinder head 28 and its components remains compact and maintenance on the camshafts 50, 60, air springs 45, 49, and valves 44, 48 can be done without having to remove the air compressor 100.

The air compressor 100 is a reciprocating air compressor, and more specifically a piston-type air compressor. In order to reduce the pressure pulses that are inherent from this type of compressor, air from the air compressor 100 flows to an accumulator chamber 104 (schematically shown in FIG. 3) that is formed in the cover 102. The accumulator chamber 104 is fluidly connected to the air supply line 90 which supplies air, first to the air springs 45, then to the air springs 49. The air supply line 90 connects the air springs 45, 49 in series, and as a result the air supply line 90 is generally C-shaped. From the last of the air springs 49, the air supply line 90 connects to a pressure relief valve 106 which prevents pressure inside the system from exceeding a predetermined level. The pressure relief valve 106 is provided since the compressor 100 is constantly miming and as a result, supplies air to the air spring system faster than is required to replace the air that escapes the air springs 45, 49.

Figure 5:
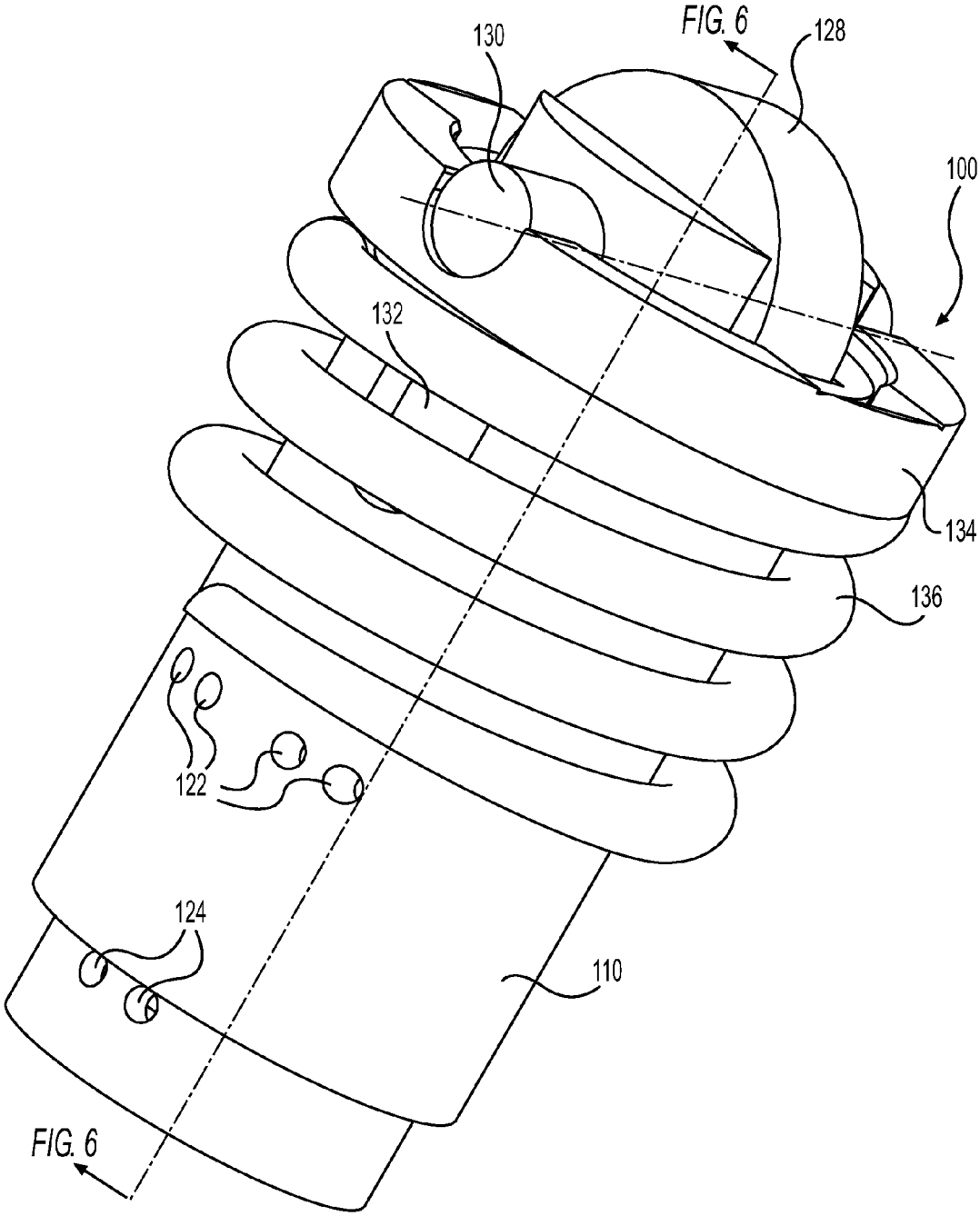
FIG. 5 is a perspective view of an air compressor of the engine of FIG. 1.
Figure 6:
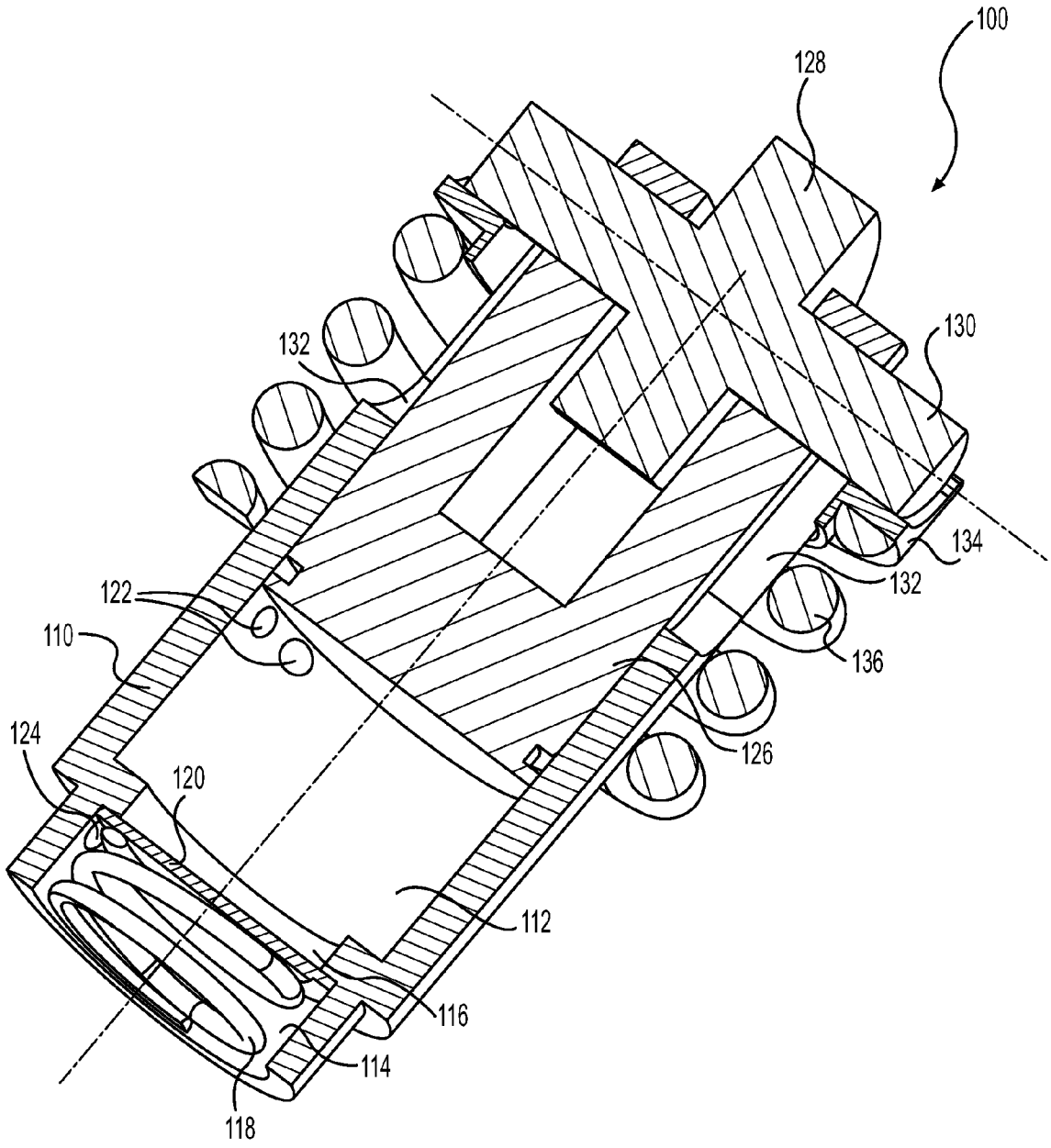
FIG. 6 is a cross-sectional view of the air compressor of FIG. 5 taken along line 6-6 in FIG. 5.
Figure 7:
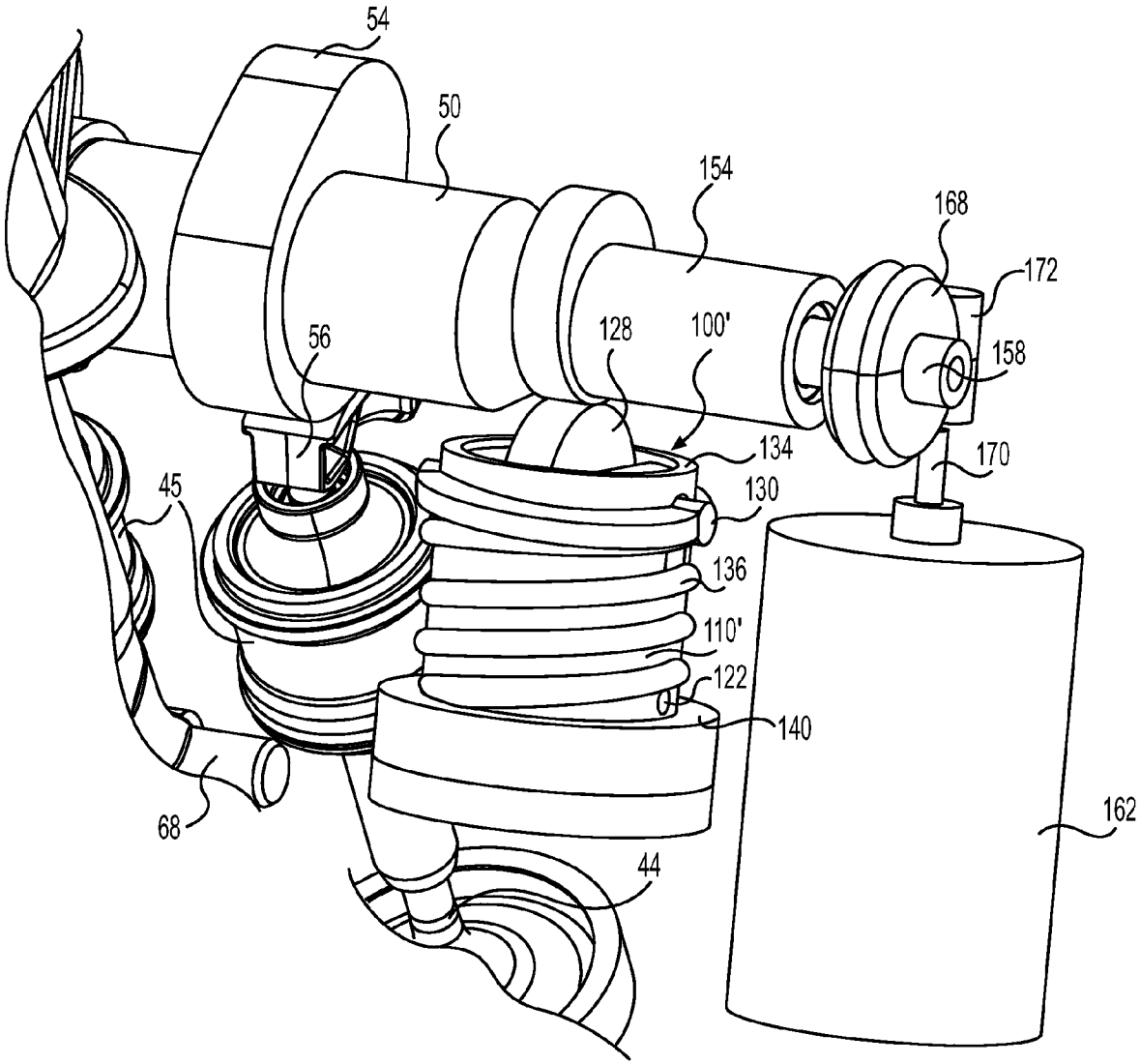
FIG. 7 is a perspective view of a second embodiment of some of the internal components of the cylinder head of the engine of FIG. 1.
Figure 8:
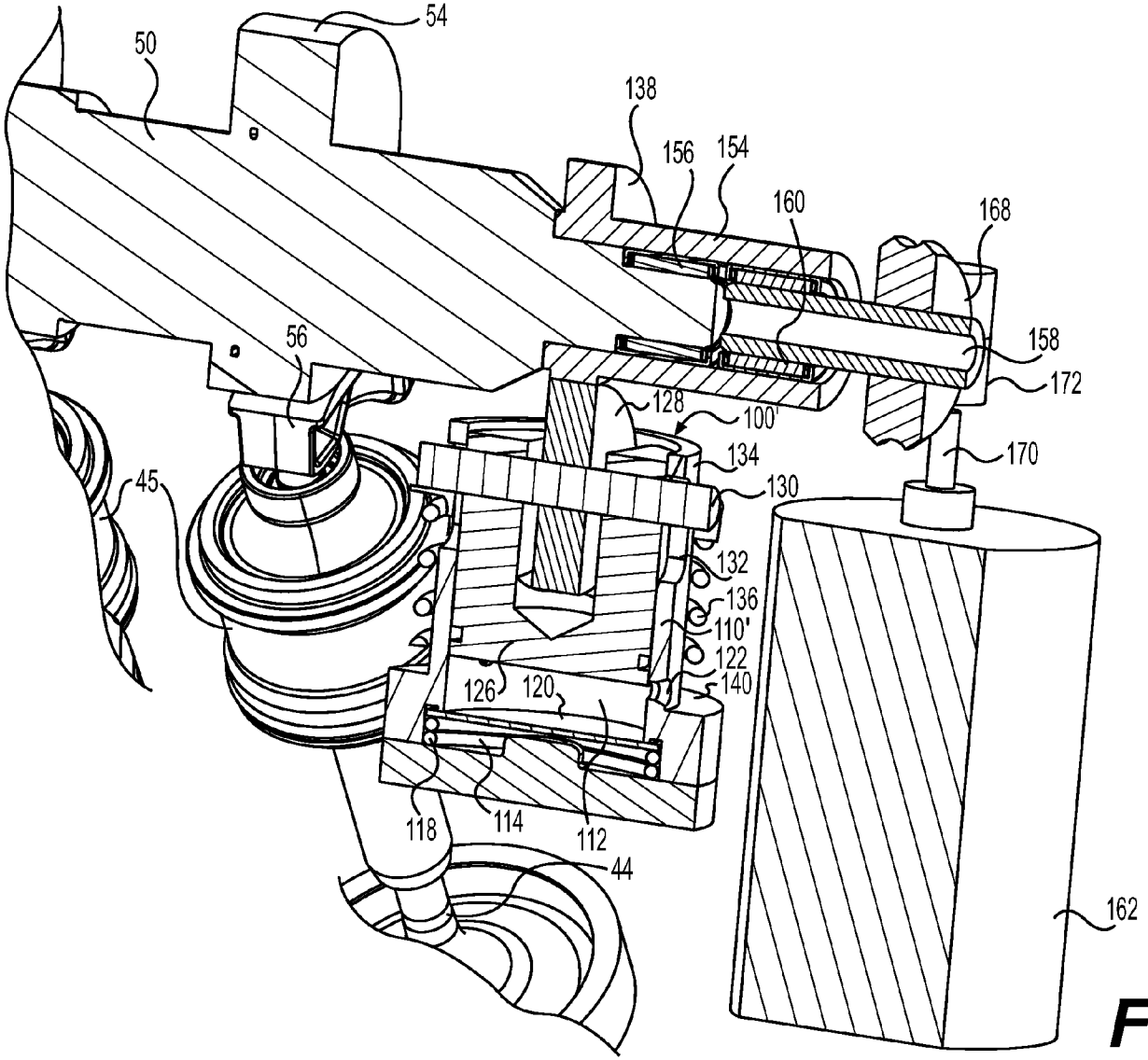
FIG. 8 is a partial cross-sectional view of the components of FIG. 7.
Figure 9:
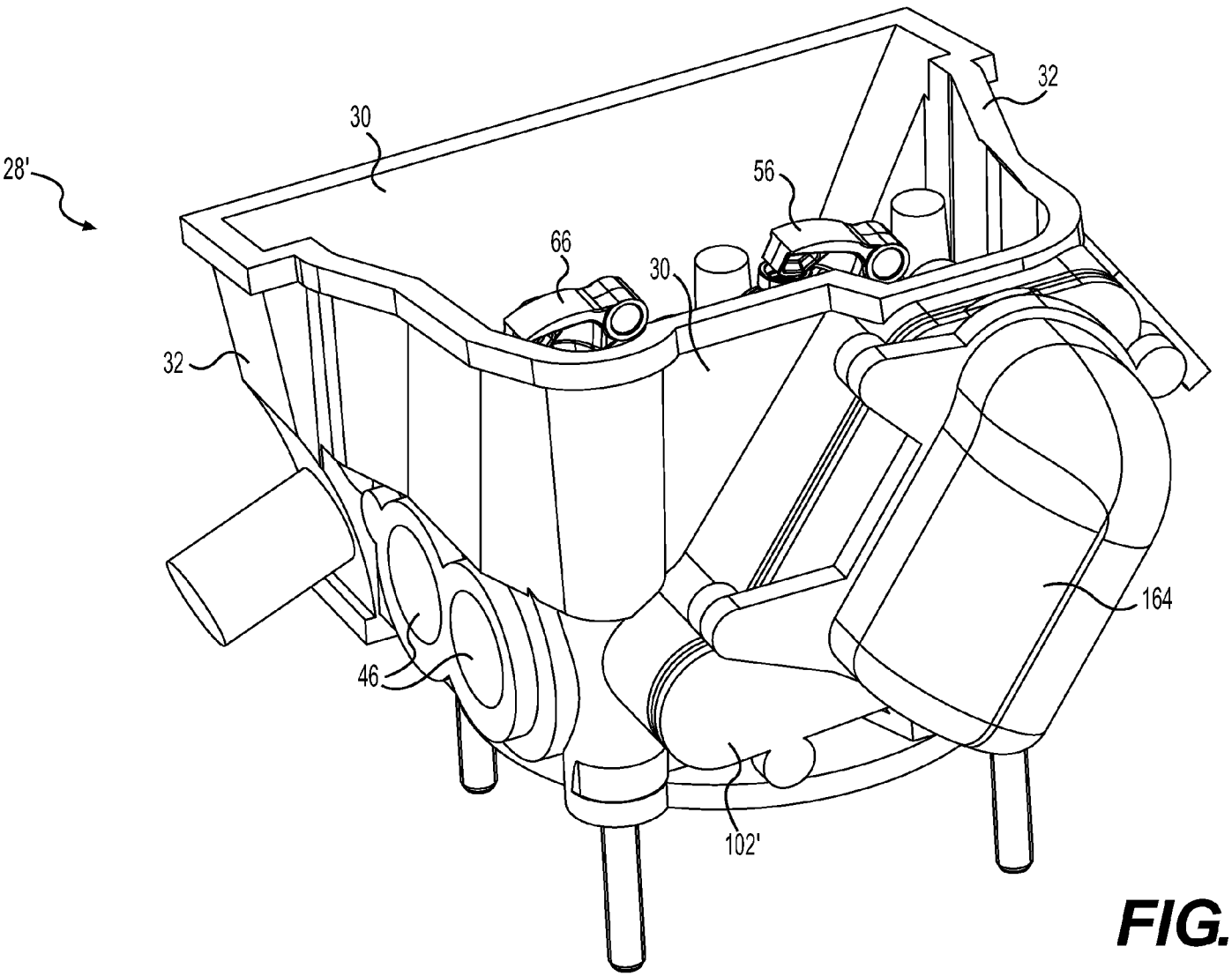
FIG. 9 is a perspective view of the cylinder head of the engine of FIG. 1 containing the internal components of FIG. 7, with the cylinder head cover removed.
Figure 10:
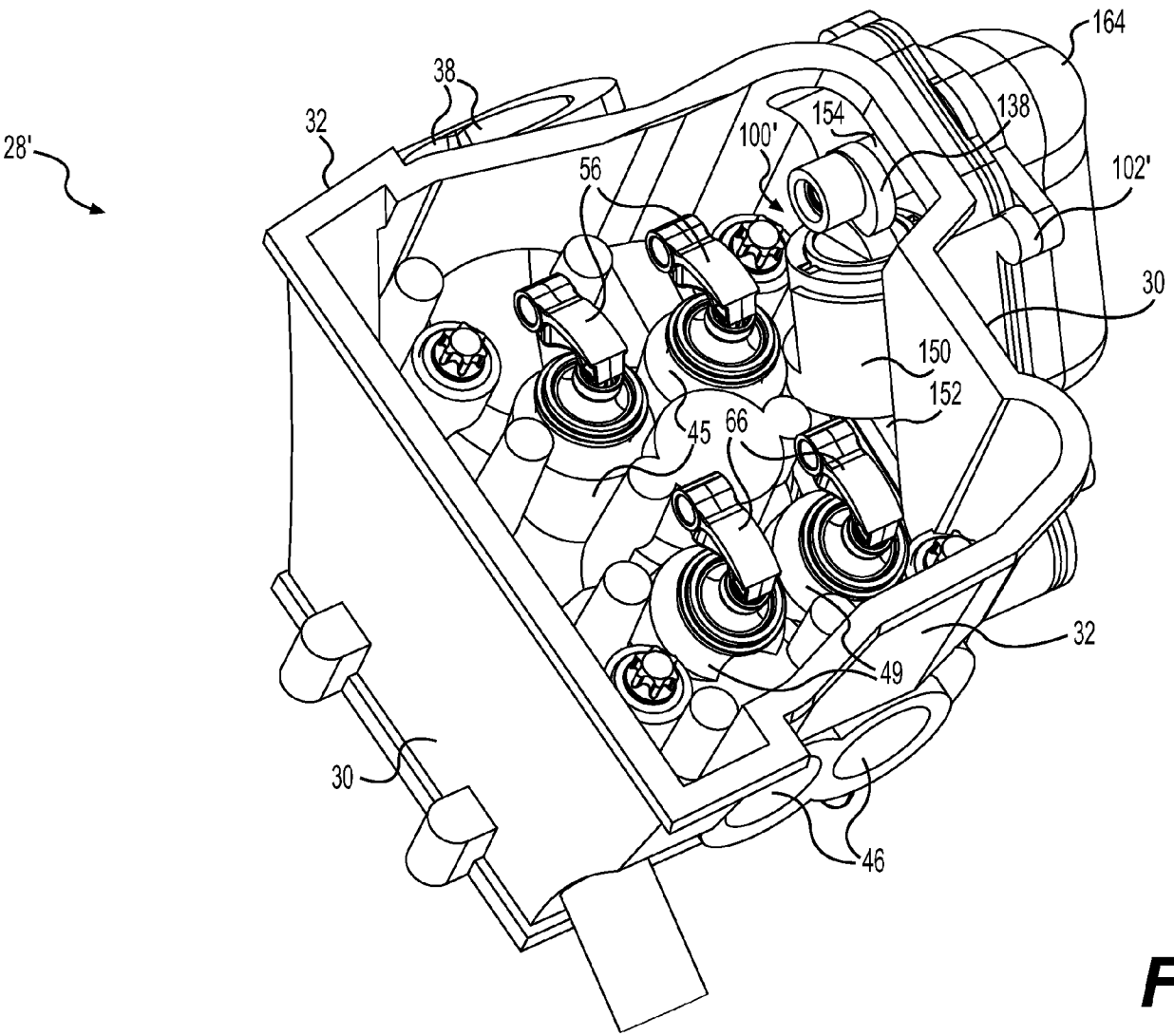
FIG. 10 is another perspective view of the cylinder head of the engine of FIG. 1 containing the internal components of FIG. 7, with the cylinder head cover removed.

Turning now to FIGS. 5 and 6, the air compressor 100 and its operation will be described in more detail. The air compressor 100 has a body 110 defining a main chamber 112 and a sub-chamber 114 that selectively fluidly communicate together via passage 116. A check valve consisting of a spring 118 and a disk 120 is disposed inside the sub-chamber 114. The spring 118 biases the disk 120 against the passage 116 so as to selectively prevent air flow from the main chamber 112 to the sub-chamber 114 via the passage 116. Air inlets 122 formed in the body 110 fluidly communicate the main chamber 112 with the atmosphere. Air outlets 124 formed in the body 110 fluidly communicate the sub-chamber 114 with the accumulator chamber 104. A piston 126 is disposed inside the main chamber 112. A wheel 128 having an integrally formed axle 130 is disposed inside the top of the piston 126 with the ends of the axle 130 extending out of the sides of the piston 126. The axle 130 passes through slots 132 formed in the body 110 of the air compressor 100 so as to guide piston 126 as it reciprocates inside the main chamber 112 as described below. A collar 134 is disposed around the body 110 and abuts the ends of the axle 130. A spring 136 is disposed between the collar 134 and the portion (not shown) of the cover 102 supporting the air compressor 100 so as to bias the piston 126 toward the position shown in FIGS. 5 and 6.

As can be seen in FIG. 3, a compressor driving cam 138 is disposed on the intake camshaft 50 engages the wheel 128 of the air compressor 100. As the intake camshaft 50 rotates, the compressor driving cam 138 pushes on the wheel 128, which in turn moves the piston 126 towards the passage 116. As it moves, the piston 126 blocks the air inlets 122, and as result the air pressure inside the main chamber 112 increases as the volume of the main chamber 112 decreases. When the air pressure inside the main chamber 112 becomes high enough to overcome the bias of the spring 118, the disk 124 moves away from the passage 116, thus allowing the pressurized air to flow from the main chamber 112 to the sub-chamber 114 via the passage 116. From the sub-chamber 114, the pressurized air flows through the outlets 124 to the accumulator chamber 104, and from there, to the air springs 45, 49, as described above. As the intake camshaft 50 continues to rotate, it no longer pushes on the wheel 128, and the spring 136 biases the piston 126 back to the position shown in FIGS. 5 and 6 and the spring 118 biases the disk 120 back against the passage 116. In this position air can enter the main chamber 112 via the inlets 122. The air compressor 100 continues to operate as described above for as long as the intake camshaft 50 rotates.

Turning now to FIGS. 7 to 11, another embodiment of a cylinder head 28' and its corresponding elements will be described. For simplicity, the elements shown in FIGS. 7 to 11 which are similar to those of FIGS. 1 to 6 have been labelled with the same reference numerals and will not be described again in detail.

In this embodiment, the air spring system is provided with an air compressor 100'. The air compressor 100' has the same construction and operates in the same way as the air compressor 100, except that the spring 136 abuts a shoulder 140 formed by the body 110' of the air compressor 100'.

Figure 11:
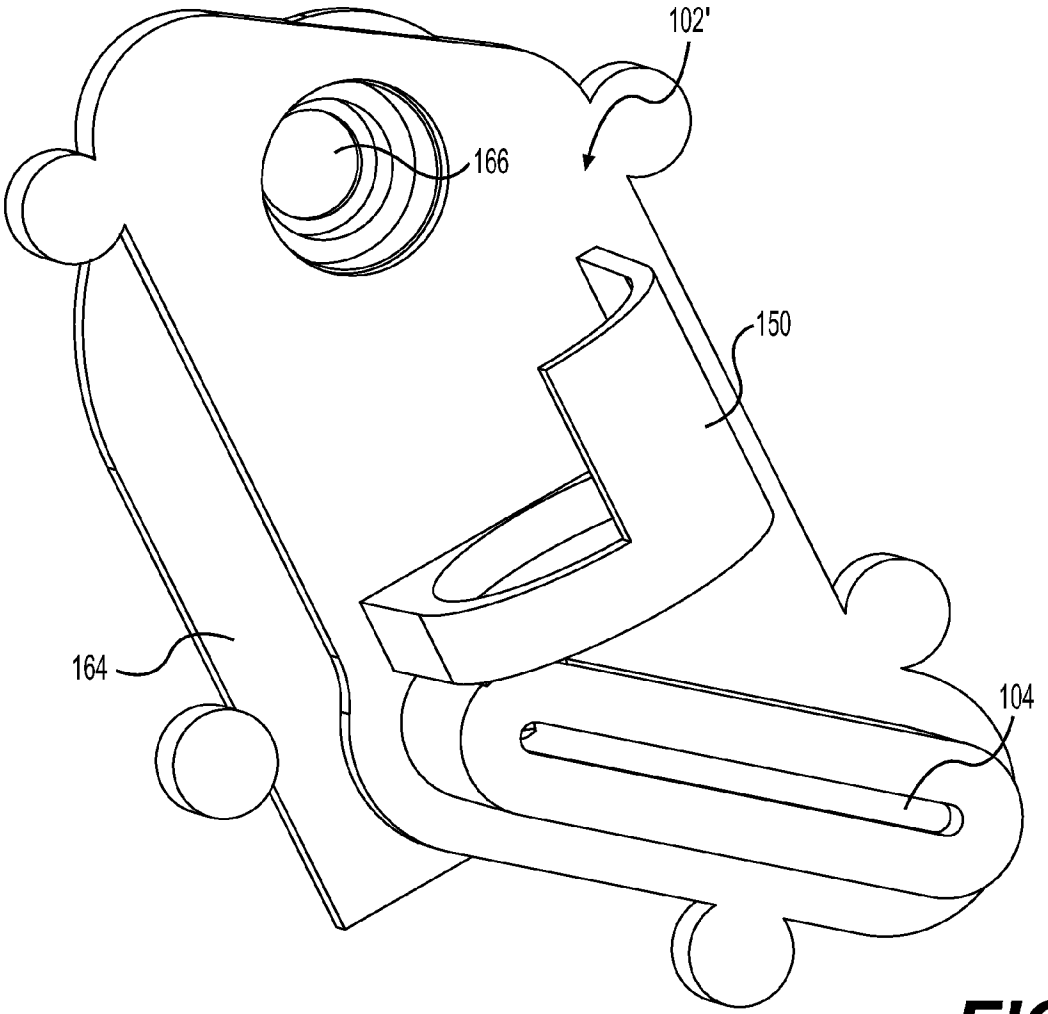
FIG. 11 is a perspective view of covers of the cylinder head of FIG. 9.

The air compressor 100' is disposed inside the cylinder head 28'. It is supported inside a holder 150 (FIG. 11) formed on an inner side of the cover 102'. As with the cover 102, the cover 102' is fastened over an aperture 152 (FIG. 10) formed in a side wall 30 of the cylinder head 28'. As can be seen in FIG. 11, the cover 102' also has an accumulator chamber 104 formed therein.

As in the system described above, from the air compressor 100', the air flows to the accumulator chamber 104, and from there to the air springs 45, 49 (in series), and then to the pressure relief valve 106.

The main difference between the system described above and the current system is in the way the air compressor 100' is driven. In this embodiment, the compressor driving cam 138 is disposed on a tubular compressor driving shaft 154. The compressor driving shaft 154 is coaxial with the intake camshaft 50. One end of the intake camshaft 50 is disposed inside one end of the compressor driving shaft 154. An overrunning clutch 156 disposed between the end of the intake camshaft 50 and the compressor driving shaft 154 selectively connects the end of the intake camshaft 50 to the compressor driving shaft 154 such that the compressor driving shaft 154, and therefore the air compressor 100', can be selectively driven by the intake camshaft 50. It is contemplated that the air compressor driving shaft 154 could alternatively be selectively connected to another rotating shaft of the engine 10, such as the exhaust camshaft 60 or the crankshaft 14.

A secondary shaft 158, which is coaxial with the compressor driving shaft 154, has one end disposed inside the other end of the compressor driving shaft 154. An overrunning clutch 160 disposed between the end of the secondary shaft 158 and the compressor driving shaft 154 selectively connects the end of the secondary shaft 158 to the compressor driving shaft 154 such that the compressor driving shaft 154, and therefore the air compressor 100', can be selectively driven by the secondary shaft 158. The secondary shaft 158 is driven by an electric motor 162.

The electric motor 162 is disposed inside a cavity (not shown) formed between the compressor cover 102' and a second cover 164 (FIGS. 9 and 10) that is fastened to the compressor cover 102'. The secondary shaft 158 passes through an aperture 166 (FIG. 11) in the compressor cover 102' and extends inside the cavity. The end of the secondary shaft 158 that is in the cavity has a gear 168 disposed thereon. The motor 162 has a motor shaft 170 that extends generally perpendicularly to the secondary shaft. The motor shaft 170 has a gear 172 disposed thereon which engages the gear 168 of the secondary shaft 158 so as to the drive the secondary shaft 158 with the motor 162.

As would be understood, due to the overrunning clutches 156, 160, the one of the intake camshaft 50 and the secondary shaft 158 which rotates the fastest during the operation of the engine 10 is the one that drives the compressor driving shaft 154, and therefore the air compressor 100'.

Figure 12:
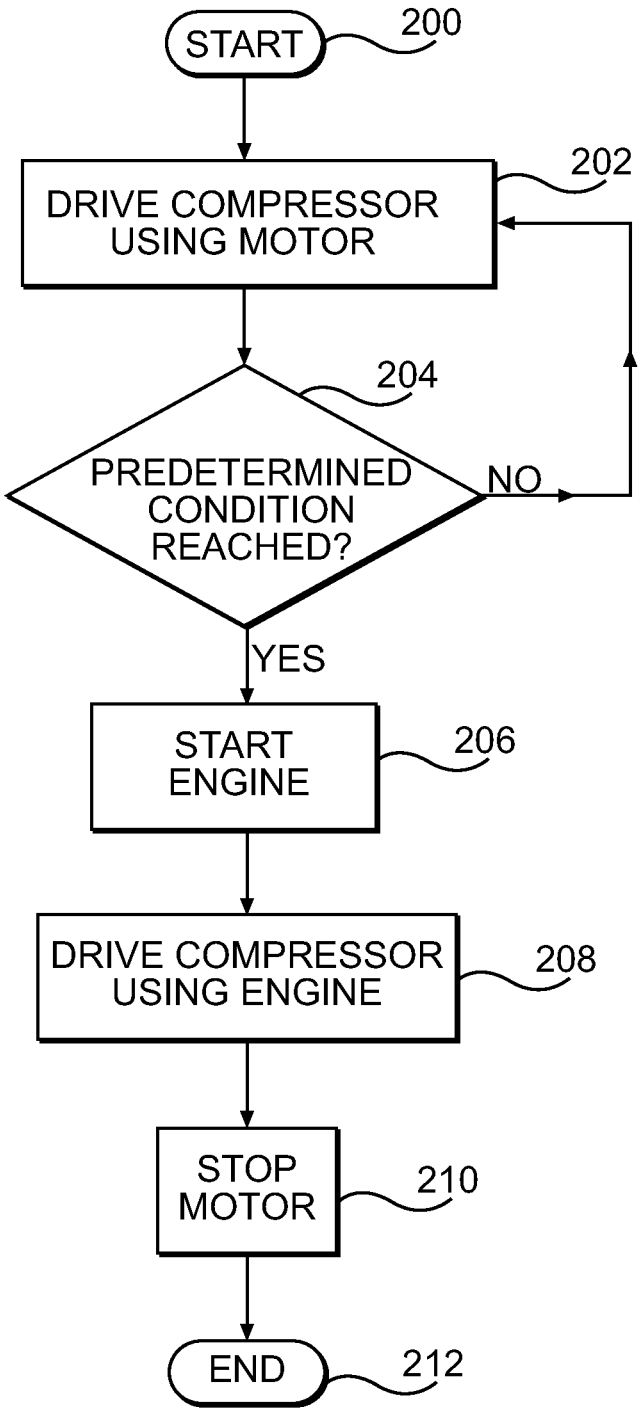
FIG. 12 is a logic diagram illustrating a method of supplying air to an air spring of the embodiment show in FIG. 7.

With reference to FIG. 12, a method of operating the system shown in FIGS. 7 to 11 will be described. The method begins at step 200 when a control unit (not shown) of the engine 10 receives an indication of a desire to start the engine 10. This indication could, for example, come from a signal received when an ignition key is turned or when a start button is pressed. Then at step 202, before starting the engine 10, the motor 162 is used to drive the compressor driving shaft 154, and therefore the air compressor 100'. Then at step 204, the control unit determines if a predetermined condition has been reached. It is contemplated that the predetermined condition could be a predetermined air pressure indicative of an air pressure inside the air springs 45, 49. The air pressure could be sensed by a pressure sensor sensing the pressure directly inside one or more of the air springs 45, 49, or inside the air supply line 90. Alternatively, the predetermined condition could be a predetermined amount of time for which the air compressor 100' is driven by the motor 162. When the predetermined condition is reached, the air compressor 100' has supplied enough air to the air springs 45, 49 such that the air springs 45, 49 bias the valves 44, 48 towards their closed positions. The motor 162 will continue to drive the air compressor 100' and the engine 10 will not be started until the predetermined condition is reached. This ensures that the piston 22 of the engine 10 will not contact the valves 44, 48 when the engine 10 is started, which might have occurred if air leaked out of the air springs 45, 49 while the engine 10 was not in use, as previously explained.

Once the predetermined condition is reached, then at step 206 the engine 10 is started, and as a result, at step 208, the engine 10 drives the air compressor 100' via the intake camshaft 50. The motor 162 is then stopped at step 210. It is contemplated that the motor 162 could alternatively be stopped as soon as the predetermined condition is reached (i.e. between steps 204 and 206). The air compressor 100' continues to be driven by the intake camshaft 50 until the engine 10 is stopped, at which point the method ends at step 212.

Figure 13:
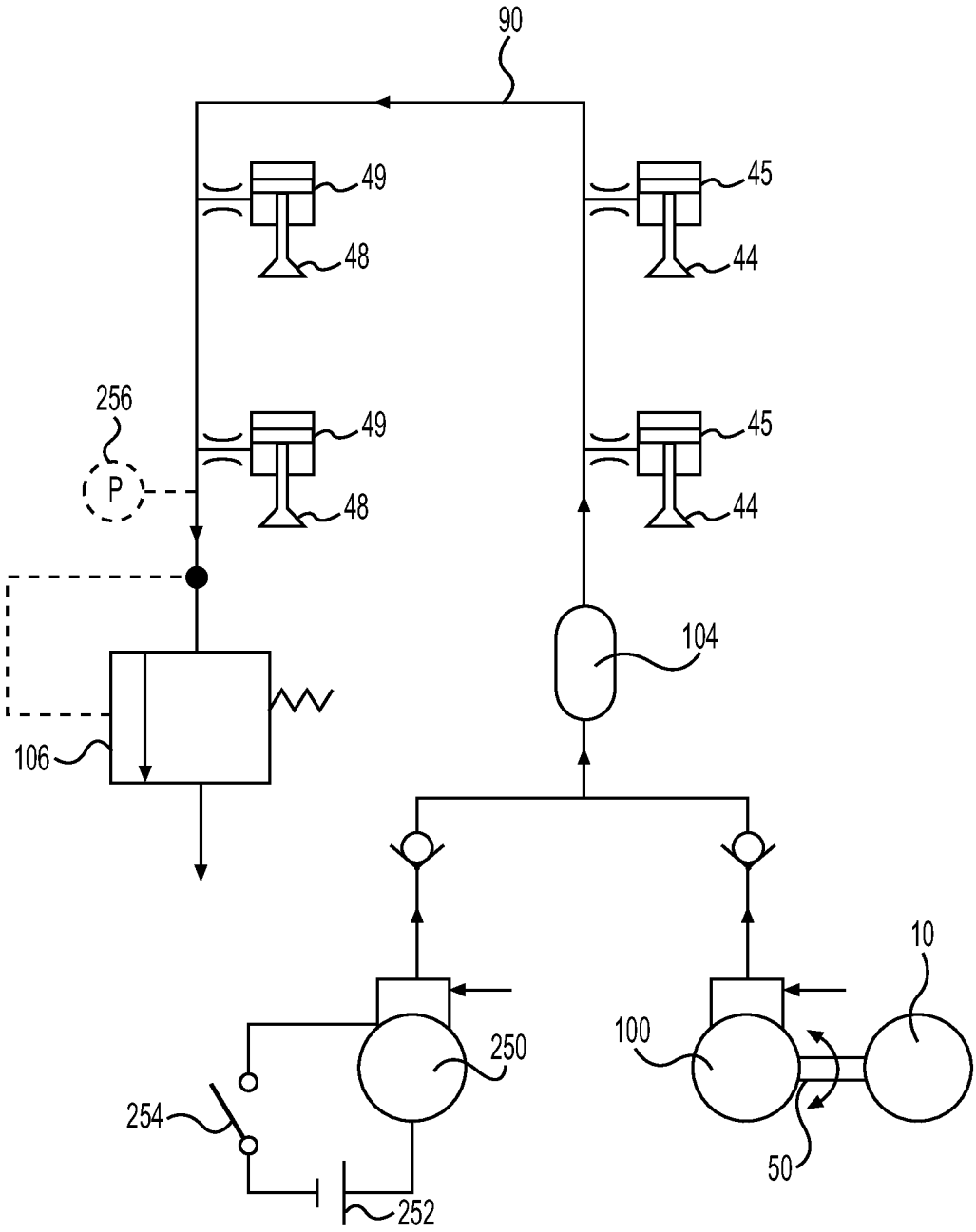
FIG. 13 is a schematic diagram of an alternative embodiment of an air spring system of the engine of FIG. 1.

Turning now to FIG. 13, another air spring system will be described. For simplicity, the elements shown in FIG. 13 which are similar to those of FIGS. 1 to 6 have been labelled with the same reference numerals and will not be described again in detail.

The air spring system shown in FIG. 13 is the same as the one shown in FIG. 3, but with the addition of a second air compressor 250. The air compressor 250 is an electrical air compressor powered by a battery 252. The battery 252 is preferably the same battery that is used for the engine 10. A switch 254 is used to turn the electrical air compressor 250 on or off. The electrical air compressor 250 is preferably disposed inside the cylinder head 28. As can be seen, the electrical air compressor 250 fluidly communicates with the accumulator chamber 104, the air supply line 90, and the air springs 45, 49 so as to supply air to the air springs 45, 49. It is contemplated that in the case that the air compressor 250 could bypass the accumulator chamber 104 and connect directly to the air supply line 90. This could be done should the air compressor 250 be of a type that provides pressurized air with relatively small pressure fluctuations.

Figure 14:
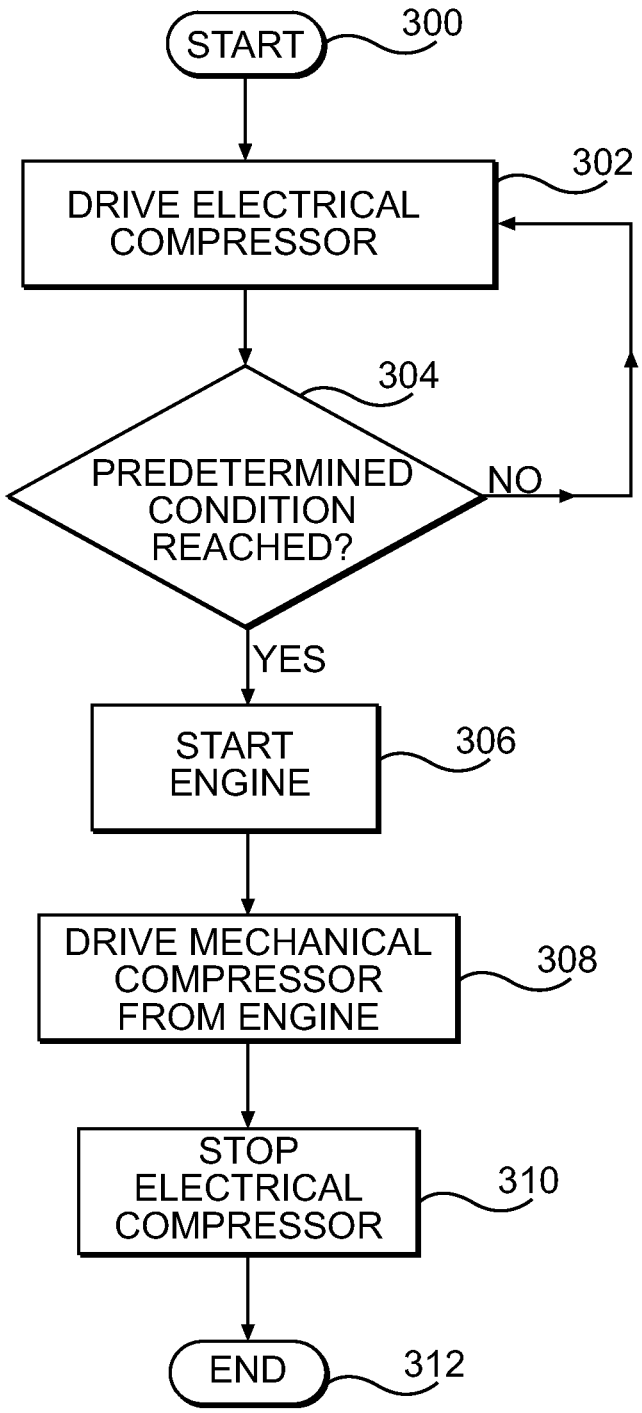
FIG. 14 is a logic diagram illustrating a method of supplying air to an air spring of the embodiment show in FIG. 13.

With reference to FIG. 14, a method of operating the system shown in FIG. 13 will be described. The method begins at step 300 when a control unit (not shown) of the engine 10 receives an indication of a desire to start the engine 10. This indication could, for example, come from a signal received when an ignition key is turned or when a start button is pressed. Then at step 302, before starting the engine 10, the switch 254 is closed and the electrical air compressor 250 is turned on to supply air to the air springs 45, 49. Then at step 304, the control unit determines if a predetermined condition has been reached. When the predetermined condition is reached, the air compressor 250 has supplied enough air to the air springs 45, 49 such that the air springs 45, 49 bias the valves 44, 48 towards their closed positions. The air compressor 250 will continue supply air to the air springs 45, 49 and the engine 10 will not be started until the predetermined condition is reached. It is contemplated that the predetermined condition could be a predetermined air pressure indicative of an air pressure inside the air springs 45, 49. The air pressure could be sensed by a pressure sensor sensing the pressure directly inside one or more of the air springs 45, 49, or inside the air supply line 90, such as pressure sensor 256. Alternatively, the predetermined condition could be a predetermined amount of time for which the air compressor 250 is driven.

Once the predetermined condition is reached, then at step 306 the engine 10 is started, and as a result, at step 308, the engine 10 drives the air compressor 100 via the intake camshaft 50. The switch 254 is then opened and the electrical air compressor 25 stopped at step 310. It is contemplated that the electrical air compressor 250 could alternatively be stopped as soon as the predetermined condition is reached (i.e. between steps 304 and 306). The air compressor 100 continues to be driven by the intake camshaft 50 until the engine 10 is stopped, at which point the method ends at step 312.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. An internal combustion engine comprising:

a crankcase;

a cylinder block connected to the crankcase, the cylinder block defining a cylinder;

a piston disposed in the cylinder;

a crankshaft disposed in the crankcase and operatively connected to the piston;

a cylinder head connected to the cylinder block, the cylinder head, the cylinder and the piston defining a combustion chamber therebetween;

at least one camshaft disposed in the cylinder head and operatively connected to the crankshaft;

at least one intake passage fluidly communicating with the combustion chamber;

at least one intake valve disposed in the at least one intake passage, the at least one intake valve selectively communicating the at least one intake passage with the combustion chamber;

a first spring operatively connected to the at least one intake valve, the first spring biasing the at least one intake valve to a closed position preventing fluid communication between the at least one intake passage and the combustion chamber;

at least one exhaust passage fluidly communicating with the combustion chamber;

at least one exhaust valve disposed in the at least one exhaust passage, the at least one exhaust valve selectively communicating the at least one exhaust passage with the combustion chamber;

a second spring operatively connected to the at least one exhaust valve, the second spring biasing the at least one exhaust valve to a closed position preventing fluid communication between the at least one exhaust passage and the combustion chamber, at least one of the first and second springs being an air spring;

at least one intake cam and at least one exhaust cam disposed on the at least one camshaft, the at least one intake cam engaging the at least one intake valve, and the at least one exhaust cam engaging the at least one exhaust valve;

an air compressor fluidly communicating with the air spring to supply air to the air spring, the air compressor being operatively connected to the at least one camshaft, the at least one camshaft selectively driving the air compressor; and a motor operatively connected to the air compressor, the motor selectively driving the air compressor.

2. The internal combustion engine of claim 1, wherein both the first and second springs are air springs, the first spring being a first air spring, and the second spring being a second air spring; and wherein the air compressor fluidly communicates with the first and second air springs to supply air to the first and second air springs.

3. The internal combustion engine of claim 2, wherein the air compressor fluidly communicates in series with the first and second air springs.

4. The internal combustion engine of claim 2, wherein the at least one intake valve is biased to the closed position only by the first air spring; and wherein the at least one exhaust valve is biased to the closed position only by the second air spring.

5. The internal combustion engine of claim 1, wherein the at least one camshaft includes an intake camshaft and an exhaust camshaft;

wherein the at least one intake cam is disposed on the intake camshaft and the at least one exhaust cam is disposed on the exhaust camshaft;

wherein rotation of the intake camshaft causes the at least one intake cam to engage the at least one intake valve such that the at least one intake cam moves the at least one intake valve to an opened position where the at least one intake passage fluidly communicates with the combustion chamber; and wherein rotation of the exhaust camshaft causes the at least one exhaust cam to engage the at least one exhaust valve such that the at least one exhaust cam moves the at least one exhaust valve to an opened position where the at least one exhaust passage fluidly communicates with the combustion chamber; and wherein the at least one camshaft selectively driving the air compressor is the intake camshaft.

6. The internal combustion engine of claim 1, further comprising:

a first overrunning clutch selectively connecting the at least one camshaft to the air compressor; and a second overrunning clutch selectively connecting the motor to the air compressor.

7. The internal combustion engine of claim 6, further comprising a compressor driving shaft operatively engaging the air compressor;

wherein the first overrunning clutch selectively connects the at least one camshaft to a first end portion of the compressor driving shaft; and wherein the second overrunning clutch selectively connects the motor to a second end portion of the compressor driving shaft.

8. The internal combustion engine of claim 7, wherein the compressor driving shaft is a tubular shaft;

wherein the compressor driving shaft is coaxial with the at least one camshaft;

wherein an end portion of the at least one camshaft is disposed inside the first end portion of the compressor driving shaft and the first overrunning clutch is disposed between the end portion of the at least one camshaft and the first end portion of the compressor driving shaft.

9. The internal combustion engine of claim 8, further comprising a secondary shaft operatively connected to the motor;

wherein the secondary shaft is coaxial with the compressor driving shaft;

wherein a first end portion of the secondary shaft is disposed inside the second end portion of the compressor driving shaft and the second overrunning clutch is disposed between the first end portion of the secondary shaft and the second end portion of the compressor driving shaft.

10. The internal combustion engine of claim 9, wherein the motor has a motor shaft, and the motor shaft is perpendicular to the secondary shaft.

11. The internal combustion engine of claim 10, further comprising:

a secondary shaft gear disposed on a second end portion of the secondary shaft; and a motor gear disposed on the motor shaft and engaging the secondary shaft gear.

12. The internal combustion engine of claim 7, wherein the air compressor is a reciprocating air compressor; and further comprising a compressor driving cam disposed on the compressor driving shaft, such that rotation of the compressor driving shaft causes the compressor driving cam to drive the air compressor.

13. The internal combustion engine of claim 1, wherein the cylinder defines a cylinder axis; and wherein the air compressor is disposed between the at least one camshaft and the crankshaft in a direction parallel to the cylinder axis.

14. The internal combustion engine of claim 1, wherein the crankshaft defines a crankshaft axis; and wherein the air compressor is disposed between the air spring and the motor in a direction parallel to the crankshaft axis.

15. The internal combustion engine of claim 1, wherein the air compressor is disposed inside the cylinder head.

16. The internal combustion engine of claim 1, further comprising a pressure relief valve fluidly communicating with the air compressor and the air spring.

* * * * *